United States Patent [19]

Sigman et al.

[11] Patent Number: 4,882,472

[45] Date of Patent: Nov. 21, 1989

[54] FLUORIDE SUPPLEMENT CALCULATOR

[75] Inventors: Susan J. Sigman, West Lafayette; Paula A. Meade, Evansville, both of Ind.

[73] Assignee: Bristol-Myers Company, New York, N.Y.

[21] Appl. No.: 293,289

[22] Filed: Jan. 5, 1989

[51] Int. Cl.[4] ..... G06C 3/00

[52] U.S. Cl. ..... 235/88 R; 235/78 R

[58] Field of Search ..... 235/78 R–78 RC, 235/88 R–88 RC, 85 R

[56] References Cited

U.S. PATENT DOCUMENTS

| | | | |
|---|---|---|---|
| 3,249,085 | 5/1966 | St. Jean | 235/116 X |
| 3,277,591 | 10/1966 | Rutkofsky | 235/88 R X |
| 3,309,017 | 3/1967 | Koskela | 235/78 R |
| 3,363,836 | 1/1968 | Lee | 235/78 R |
| 3,640,453 | 2/1972 | Caillouet | 235/615 |
| 3,858,798 | 1/1975 | Feingold | 235/116 X |
| 4,037,782 | 7/1977 | Jackson | 235/78 R |
| 4,251,721 | 2/1981 | Rathbun | 235/78 R |

*Primary Examiner*—B. R. Fuller

*Attorney, Agent, or Firm*—Robert H. Uloth

[57] ABSTRACT

A fluoride supplement calculator utilizes two concentrically positioned relatively rotatable disks. A front disk has a plurality of fluoride level apertures which overlie groups of fluoride dosage amounts carried on the second disk. An age scale is also placed on the obverse surface of the second disk. The second disk has a single aperture which is used in conjunction with the reverse surface of the first disk to depict fluoride uptake and enamel formation in teeth of patients of various ages.

4 Claims, 4 Drawing Sheets

FLUORIDE SUPPLEMENT CALCULATOR

FIELD OF THE INVENTION

The present invention is directed generally to a fluoride supplement calculator. More particularly, the present invention is directed to a patient age correlating fluoride supplement calculator. Most specifically, the present invention is directed to a patient age and water supply fluoride content correlating fluoride supplemental calculator. A pair of information bearing disks are joined for relative rotation. One of the disks carries an age scale and three separate groups of fluoride supplement amounts about its periphery. The second disk, which overlies the first includes an age selector and three spaced apertures, each of which overlies one of the fluoride supplement amount groups. The reverse side of the age scale and fluoride supplement amount groups disk carries an aperture which overlies the reverse of the multiple apertured disk. This reverse side of the fluoride supplement calculator depicts fluoride uptake in teeth.

DESCRIPTION OF THE PRIOR ART

Various calculating devices and the like, which use a plurality of stacked, relatively rotatable disks, are generally known in the art. These are used to calculate or compute such diverse things as golf club selection, engine conditions, nautical data, and decorator styles. The following patents are exemplary of prior art patents of this type:

| Patents | Inventors |
|---|---|
| 3,249,085 | St. Jean |
| 3,277,591 | Rutkofsky |
| 3,309,017 | Koskela |
| 3,363,836 | Lee |
| 3,640,453 | Caillouet |
| 3,858,798 | Feingold |
| 4,037,782 | Jackson |
| 4,251,721 | Rathbun |

It is generally acknowledged that fluoride is an effective means for the prevention or inhibition of dental caries. Most dentists recommend some type of fluoride treatment, particularly for children so that the developing teeth will be provided with fluoride protection. Various topical fluoride agents can be applied during routine dental exams. The use of fluoride supplements, typically in the form of a daily dosage has also been determined to be an effective means for the incorporation of fluoride into teeth as their mineralization occurs. These fluoride supplements provide systemic fluoride for this mineralization and also provide fluoride that is secreted in saliva where it aids in the maturation of teeth after the teeth have erupted.

Numerous municipalities and other government jurisdictions add fluoride to the local drinking water. The level of fluoride added is usually a constant for a particular jurisdiction but may well vary between adjacent jurisdictions or water treatment areas.

At present, a dental practitioner who wishes to provide his patients with a daily fluoride supplement has no easy means to determine the appropriate level of this daily dosage. The amount of fluoride to be taken daily depends on the age of the patient, typically a child, and on the fluoride level in the local jurisdiction. Even when the practitioner knows the dosages dictated by the fluoride level in his own jurisdiction, he may have patients from adjoining areas whose water has a different fluoride level. There presently does not exist a simple, inexpensive means for quickly and accurately ascertaining the daily fluoride supplement needed by a patient, taking into consideration the age of the patient and the level of fluoride in the patient's drinking water. While various charts and graphs exist, they are not convenient to use and also are not particularly suitable for distribution to patients or their parents.

Many parents, and children, are interested in knowing the age at which a child will typically start the process of having primary or baby teeth erupt and when these teeth will be replaced with permanent teeth. Again, there are various charts which show these events but often these are either not in a format which is readily understood by a parent or are simply not conveniently distributable to a parent or child. Further, there presently is not available any device which also depicts the incorporation of fluoride into the teeth during the mineralization process in a manner which presents this information in a graphic, easily understood manner. Thus the parents of the child may not be aware of the need for proper fluoride treatment for their child even before the child's first tooth has erupted.

It will thus be seen that a need exists for a fluoride supplement calculator and fluoride uptake display device which will allow the dental practitioner to select the appropriate fluoride supplement dosage and to effectively illustrate fluoride uptake. The fluoride supplement calculator in accordance with the present invention provides such a device and is a significant advance in the art.

SUMMARY OF THE ART

It is an object of the present invention to provide a fluoride supplement calculator.

Another object of the present invention is to provide a fluoride supplement calculator that takes into consideration the age of the patient.

A further object of the present invention is to provide a fluoride supplement calculator which is useable in areas with varying water supply fluoride levels.

Yet another object of the present invention is to provide a fluoride supplement calculator which graphically illustrates fluoride uptake as a function of age.

Still another object of the present invention is to provide a fluoride supplement calculator which is easy to use.

Even yet another object of the present invention is to provide a fluoride supplement calculator which is effective yet inexpensive.

As will be discussed in the description of the preferred embodiment which is set forth subsequently, the fluoride supplement calculator in accordance with the present invention is comprised of two concentric apertured disks which are joined together about a central point for rotation with respect to each other. On the obverse side of the smaller disk there are three spaced apertures, each representative of a particular range of drinking water fluoride content, and a pointer. These three apertures and pointer are generally equally spaced around the periphery of the smaller disk. This smaller disk overlies a larger disk whose obverse peripheral face is also divided generally into four quadrants. One of these quadrants is an age scale while the other three carry various fluoride supplement amounts. The age scale quadrant is used with the age indicator on the smaller disk while the three groups of fluoride supplement amounts are used with the three fluoride water supply level apertures.

The reverse surface of the larger disk has an elongated aperture while the reverse surface of the smaller disk depicts various tooth configurations and fluoride uptakes for various age levels. This portion of the fluoride supplement calculator thus provides a graphic depiction of the various ages in which fluoride uptake commences in various primary and permanent teeth.

The fluoride supplement calculator in accordance with the present invention allows the dental practitioner to quickly and accurately determine a suitable fluoride supplement daily dosage amount for a particular patient based on that patient's age and the fluoride level in his drinking water. The practitioner rotates the inner small disk until the age pointer on its obverse surface is aligned with the proper age on the age scale printed on the larger disk. Then knowing the water supply fluoride level, the calculator's user may read the appropriate daily fluoride supplement amount through the particular aperture which corresponds to the existing water supply fluoride level. At the same time, the practitioner may use the reverse side of the fluoride supplement calculator to graphically show the patient the amount of fluoride uptake at his particular age. This duality of functions thereby allows the dental practitioner to ascertain the amount of daily fluoride supplement which the patient should take and also allows him to impress upon the patient and his parents the importance maintaining of proper fluoride levels.

The fluoride supplement calculator in accordance with the present invention provides a highly effective means for accurately ascertaining fluoride supplement amounts and for impressing the importance of this course of action on the patient. These capabilities are not provided for in the prior art and the fluoride supplement calculator in accordance with the present invention is thus a substantive improvement.

BRIEF DESCRIPTION OF THE DRAWINGS

While the novel features of the fluoride supplement calculator in accordance with the present invention are set forth with particularity in the appended claims, a full and complete understanding of the invention may be had by referring to the detailed description of the preferred embodiment which is set forth subsequently, and as illustrated in the accompany drawings, in which:

DESCRIPTION OF THE PREFERRED EMBODIMENT

Figure 1:
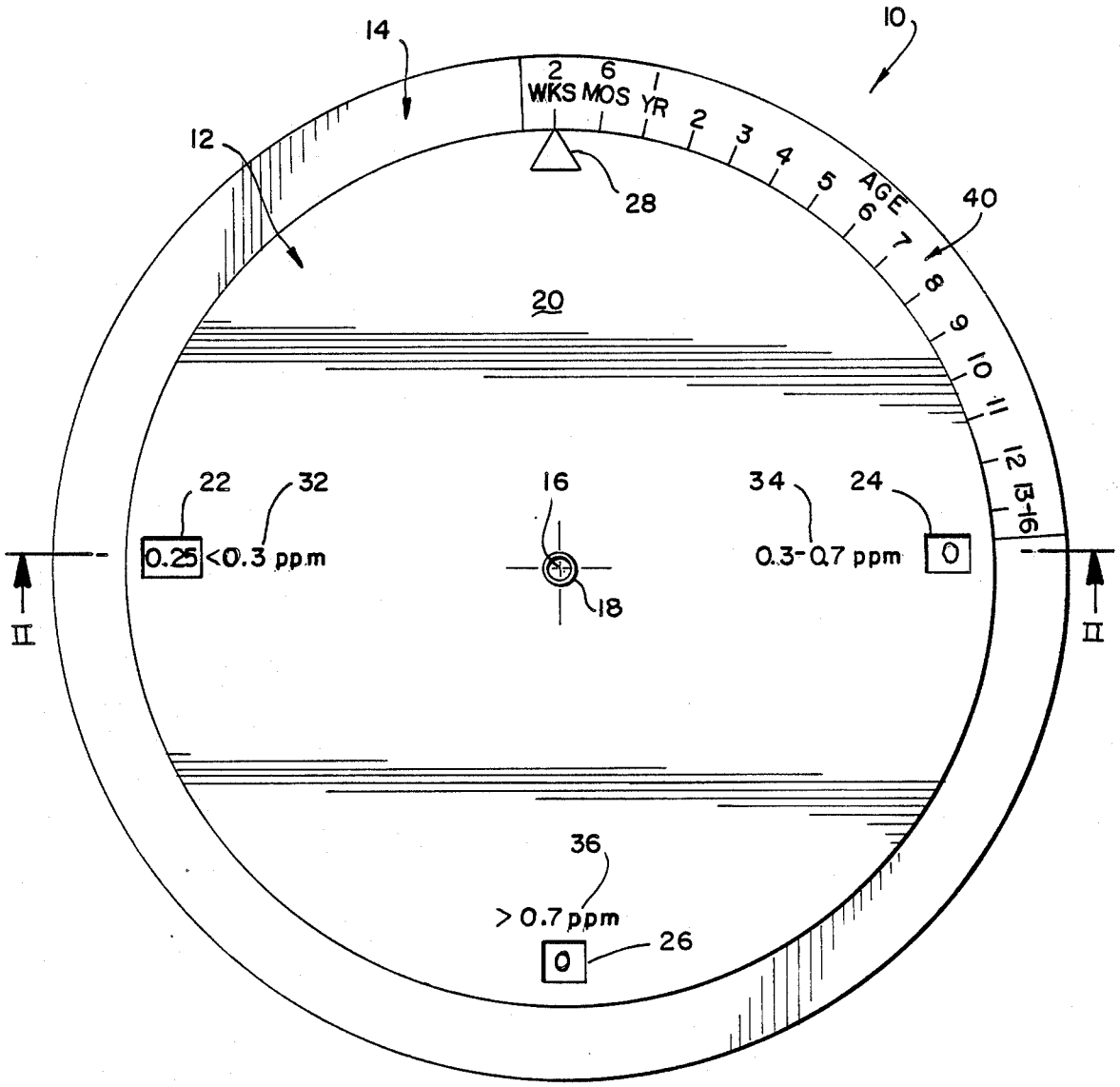
FIG. 1 is a front elevation view of the obverse face of the fluoride supplement calculator in accordance with the present invention.
Figure 2:
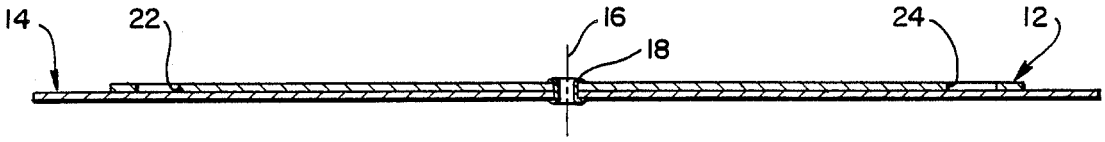
FIG. 2 is a cross sectional view of the fluoride supplement calculator taken along line II—II of FIG. 1.

Referring initially to FIG. 1 there may be seen, generally at 10, a preferred embodiment of a fluoride supplement calculator in accordance with the present invention. Fluoride supplement calculator 10 is comprised generally of a first smaller, multi-apertured disk 12 and a second, larger, single apertured disk 14. Multi-apertured disk 12 and single apertured disk 14 are affixed together for relative rotation about a common central axis of rotation 16, as seen in FIGS. 1 and 2, by a suitable fastening means, such as a rivet 18 or the like. Thus these two disks 12 and 14 are concentrically held together and are rotatable with respect to each other. Preferably the two disks 12 and 14 are fabricated from paper stock or plastic which will readily receive printing yet which will be durable and will tolerate repeated handling and manipulation.

The obverse or front face 20 of the first multi-apertured disk 12 has a multiplicity of spaced, generally peripherally positioned water supply fluoride level apertures with, in the preferred embodiment, there being three such apertures 22, 24 and 26. Further, this front surface 20 of multi-apertured disk 12 has an age scale indicator 28 which, in the preferred embodiment is generally in the shape of an arrowhead but which may take any desired form. Age scale indicator 28 may be printed on the obverse face of first disk 12 or alternatively could be an embossed or raised surface or the like. The three small fluoride level apertures 22, 24 and 26 and the age scale indicator 28 are evenly spaced, in the preferred embodiment of the fluoride supplement calculator, about the periphery of the obverse surface 20 of first disk 12 at generally 90° intervals with respect to each other. Each of the three small apertures 22, 24 and 26 has a different water supply fluoride level range legend 32, 34 and 36 printed or otherwise placed adjacent it. These three legends 32, 34 and 36 are selected to allow the user of the fluoride supplement calculator 10 to select the appropriate fluoride level aperture 22, 24 or 26 based on his knowledge of the fluoride level in the patient's drinking supply. These range legends 32, 34 and 36 are typically expressed in parts per million, as depicted in FIG. 1.

Figure 3:
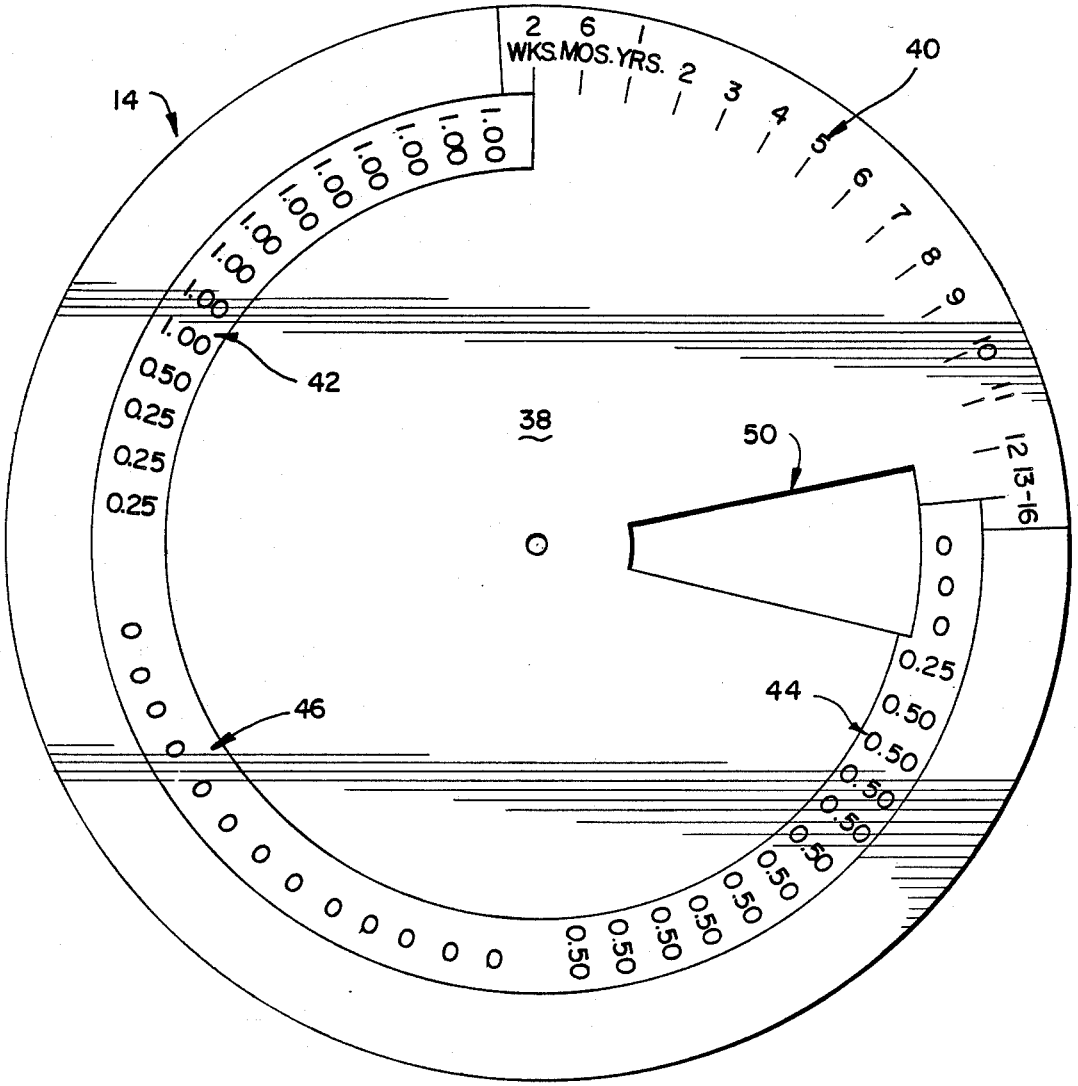
FIG. 3 is a front elevation view of the obverse face of the larger disk of the fluoride supplement calculator with the smaller overlying disk removed.

Turning now to FIG. 3, the obverse face of the second, larger, single apertured rear disk 14 may be seen generally at 38. It will be understood that in FIG. 3 the front smaller multi-apertured disk 12 has been removed for purposes of clarity. Obverse face 38 of rear disk 14 has printed or otherwise applied to it an age scale 40, and a plurality of groups of fluoride supplement daily dosage amounts 42, 44 and 46. This age scale 40 and groups of fluoride supplement daily dosage amounts 42, 44 and 46 are spaced evenly about the periphery of the obverse face 38 of rear disk 14. As can be seen, the age scale 40 is situated at the periphery of rear disk 14 while the fluoride supplement groups 42, 44 and 46 are positioned somewhat radially inwardly so that they will be covered by the front multiple apertured disk 12 when fluoride supplement calculator 10 is assembled, as seen in FIG. 1. The number of fluoride supplement groups 42, 44 and 46 on the obverse face 38 of rear disk 14 and the number of fluoride level apertures 22, 24 and 26 on the obverse surface 20 of front disk 12 are the same. These fluoride supplement daily dosage amounts are typically expressed in milligrams per day.

In use, the dental practitioner can quickly and easily ascertain the appropriate daily fluoride supplement dosage amount to prescribe for his patient as a function of the patient's age and the fluoride level in the patient's water supply. For instance, as depicted in FIG. 1, if the patient were a newborn infant, the front disk 12 would be rotated with respect to the rear disk 14 to align the age scale indictor 28 on front disk 12 with the 2 wk age on the age scale 40 on the rear disk 14. Knowing the fluoride level in the local water supply, the user could then select the fluoride level aperture 22, 24 or 26 which corresponds to the known fluoride level, as indicated by the water supply fluoride range legends 32, 34 and 36. Assuming that the local water supply had a fluoride level less than 0.3 ppm, the user would utilize fluoride aperture 22 and would thus prescribe a daily fluoride supplement dosage of 0.25 mg. If the patient were older, for example, a child of 8, the front disk 12 would be rotated to align the age scale indicator 28 with the age 8 on the age scale 40 on rear disk 14. This would indicate to the practitioner that, again given a local water supply with less than 0.3 ppm fluoride, a daily fluoride supplement dosage of 1.00 mg would be appropriate. If the local fluoride water supply was in a different range, the appropriate fluoride dosage would be read from either group 44 or 46 through either aperture 24 or 26.

Figure 4:
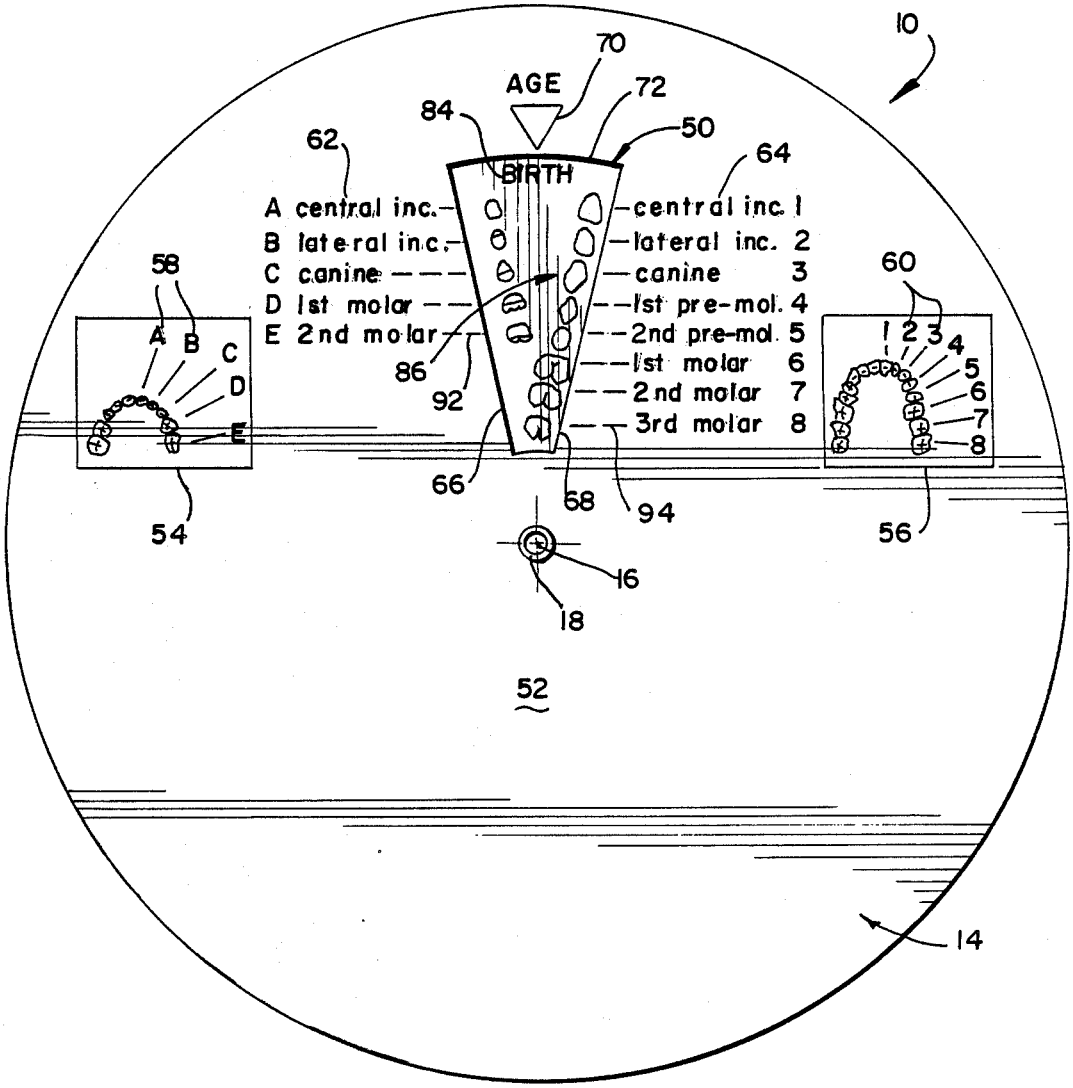
FIG. 4 is a rear elevation view of the reverse side of the fluoride supplement calculator.

Referring now to FIG. 4, the reverse portion of the fluoride supplement calculator 10 is depicted. This reverse surface of calculator 10 depicts the location of fluoride uptake in tooth enamel as a function of age and thus performs a separate educational function. As may be seen in FIG. 4 and also in FIG. 3, rear disk 14 has a single, generally truncated pie-shaped aperture 50 which is located intermediate the central axis 16 of the calculator and the periphery of the rear disk 14. On its reverse face 52 rear disk 14 carries a chart of primary teeth 54 and a chart of permanent teeth 56. Each of these charts depicts an upper arch of teeth with the teeth in the primary chart 54 being identified by alphabetic indicators 58 and the teeth in the permanent chart 52 being identified by numeric indicators 60. These same alphabetic and numeric indicators 58 and 60 are used with corresponding listings 62 and 64 of primary and permanent teeth, respectively, which, as may be seen in FIG. 4 are positioned adjacent the two radially extending sides 66 and 68 of generally pie-shaped aperture 50 in rear larger disk 14. An age indicating pointer 70 is placed adjacent the outer circumferential side 72 of aperture 50.

Figure 5:
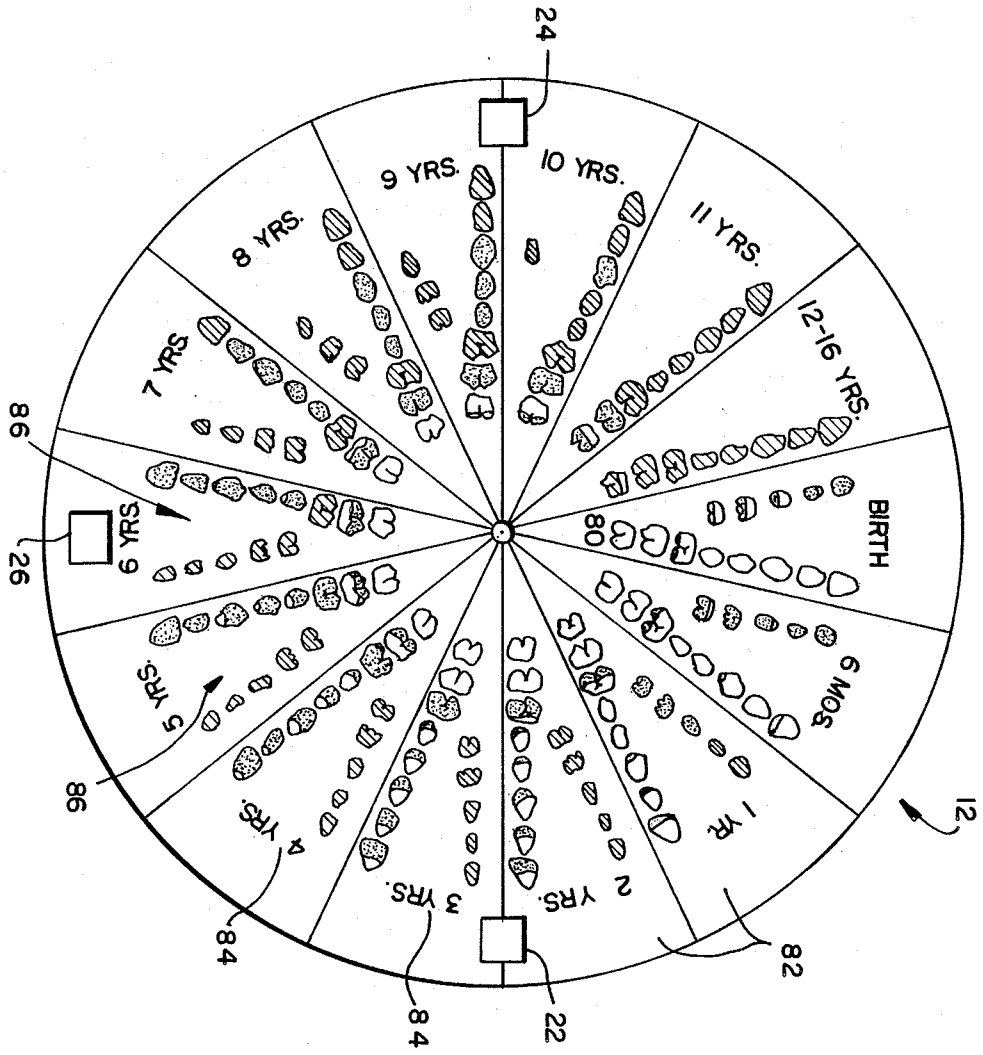
FIG. 5 is a rear elevation view of the rear side of the smaller disk of the fluoride supplement calculator.

Turning now to FIG. 5, the reverse face 80 of front disk 12 may be seen. It will be understood that in FIG. 5 the normally overlying rear disk 14 has been removed for purposes of illustration. The rear surface 80 of front disk 12 is divided into a plurality of generally pie-shaped segments 82, each of which is sized to be viewable through the truncated pie-shaped aperture 50 in rear disk 14. Each of these pie-shaped segments carries an age indicator 84, ranging from "birth" to "12–16 yrs" and an array of teeth 86 appropriate for that age. These arrays of teeth 86 are suitably colored or differentiated to pictorially depict the extent of enamel formation and fluoride uptake prior to tooth eruption and the age of tooth eruption. For example, at birth only several of the primary teeth have enamel formation and only a portion of the 1st molar has enamel formation. In the drawings stippled areas indicate extent of enamel formation whereas crosshatched areas indicate tooth eruption.

In use of the fluoride supplement calculator 10 for the depiction of the location of fluoride uptake in the tooth enamel, the practitioner may rotate the front 12 and rear 14 disks with respect to each other until the appropriate age indicator 84 on the rear face 80 of the front disk 12 appears beneath the age indicating pointer 70 on the rear surface 52 of the rear disk 14. This will position the appropriate array of teeth 84 in the single aperture 50 so that the practitioner may graphically display the location and extent of fluoride uptake in tooth enamel to his patient. As may also be seen in FIG. 4, the listings of primary and permanent teeth 62 and 64 have associated lead lines 92 and 94, respectively which points toward the appropriate teeth in the group of teeth being shown in aperture 50 on rear disk 14. This second aspect of the fluoride supplement calculator 10 of the present invention thus allows the dental practitioner to demonstrate for his patient and the patient's parent in an effective manner the importance of proper fluoride supplementation at an early age so that an effective amount of fluoride will be incorporated in the person's teeth as mineralization occurs.

The fluoride supplement calculator 10 in accordance with the present invention is useable to perform two separate but interrelated functions. It provides a helpful device for readily ascertaining a fluoride supplement daily dosage as a function of the patient's age and the fluoride level is the local water supply. It also provides an effective device for depicting the process of enamel formation in teeth and the corresponding fluoride uptake in this enamel. Thus it provides the dental practitioner with a highly usable prescribing aid and teaching tool which, if desired, may be given to the patient as a reminder of the importance of his daily fluoride supplement and the effect which it has on the fluoride level in the developing teeth.

While a preferred embodiment of a fluoride supplement calculator in accordance with the present invention has been set forth fully and completely hereinabove, it will be apparent to one of skill in the art that changes in, for example, the overall sizes of the disks, the type of fastening device, the particular materials used and the like may be made without departing from the true spirit and scope of the present invention which is accordingly to be limited only by the following claims.

What is claimed is:

1. A fluoride supplement calculator useable to determine a daily fluoride supplement as a function of a person's age and a water supply fluoride level and further useable to depict fluoride uptake during tooth enamelization said fluoride supplement calculator comprising:

a first small disk having an obverse face and a reverse face and a second larger disk having an obverse face and a reverse face;

means for securing said first and second disks together in a concentric manner for relative rotation with respect to each other about a central axis;

a plurality of fluoride level apertures in said first disk and an age scale indicator formed on said obverse face of said first disk, said plurality of fluoride level apertures and said age scale indicator being generally evenly spaced about a peripheral portion of said obverse face of said first disk, each of said fluoride level apertures having a different, water supply fluoride legend associated with it;

an age scale and a plurality of groups of fluoride supplement dosage amounts on said obverse surface of said second disk, said plurality of fluoride level apertures and said plurality of said fluoride supplement dosage amounts being the same, said fluoride dosage amounts underlying and being visible through said fluoride level apertures and said age scale being visible and adjacent said age scale indicator when said first and second disks are secured together, said disks being rotatable relative to each other to align said age scale indicator with the person's age as set forth on said age scale so that an appropriate fluoride dosage amount will be depicted in the one of said plurality of fluoride level apertures which corresponds to the person's water supply fluoride level;

a single aperture in said second disk and a cooperating age indicating pointer on said reverse surface of said second disk; and a plurality of arrays of teeth and age indicators on said reverse surface of said first disk, said single aperture being sized to facilitate viewing of a selected one of said plurality of arrays of teeth, said age indicating pointer being useable to indicate the age indicator for the selected array of teeth, each of said arrays of teeth depicting a location of fluoride uptake and tooth enamelization appropriate for the age identified by said associated age indicator.

2. The fluoride supplement calculator of claim 1 wherein there are three of said fluoride level apertures in said first disk.

3. The fluoride supplement calculator of claim 1 wherein said single aperture in said second disk is a generally truncated pie-shaped aperture.

4. The fluoride supplement calculator of claim 1 wherein said reverse face of said second disk further includes listings of primary and permanent teeth and associated lead lines which extend to opposing sides of said single aperture and identify individual teeth in said selected one of said plurality of arrays of teeth visible through said single aperture in said second disk.

* * * * *